US005996691A

United States Patent [19]

Norris et al.

[11] Patent Number: 5,996,691

[45] Date of Patent: Dec. 7, 1999

[54] CONTROL APPARATUS AND METHOD FOR CONTROLLING THE RATE OF LIQUID REMOVAL FROM A GAS OR OIL WELL WITH A PROGRESSIVE CAVITY PUMP

[76] Inventors: Orley (Jay) Norris, 7664 Timbers Trails, Traverse City, Mich. 49637; David S. Findley, Sr., 849 Oak Grove, Gaylord, Mich. 49735

[21] Appl. No.: 08/956,696

[22] Filed: Oct. 24, 1997

Related U.S. Application Data

[60] Provisional application No. 60/029,269, Oct. 25, 1996.

[51] Int. Cl.[6] ..... E21B 43/00; E21B 47/04

[52] U.S. Cl. ..... 166/250.03; 166/68.05; 166/250.15; 73/290 R; 417/63

[58] Field of Search ..... 166/68, 68.05, 166/250.03, 250.15; 73/290 R; 340/620, 618; 417/44.1, 63, 410.1

[56] References Cited

U.S. PATENT DOCUMENTS

| | | | |
|---|---|---|---|
| 4,171,016 | 10/1979 | Kempton | 166/68 |
| 4,389,164 | 6/1983 | Godbey et al. | 417/36 |
| 4,854,164 | 8/1989 | Rhoads | 73/155 |
| 5,143,153 | 9/1992 | Bach et al. | 166/68.5 |
| 5,490,564 | 2/1996 | Schultz et al. | 166/374 |
| 5,634,522 | 6/1997 | Hershberger | 166/372 |
| 5,820,350 | 10/1998 | Mantey et al. | 417/45 |

*Primary Examiner*—William Neuder
*Assistant Examiner*—Chong S. Cho
*Attorney, Agent, or Firm*—Waters & Morse, P.C.

[57] ABSTRACT

A method and apparatus for controlling the level efficiently, and rate of removal of water from an oil or gas well using a progressive cavity pump operated by a rotating drive shaft extending downwardly from ground level to the pump comprises a sensor that detects the downward force on the shaft produced by the dynamic operation of the pump; and a control mechanism responsive to the output from the sensor that correlates the downward force on the pump with liquid depth in the casing and controls pump speed in order to achieve a desired rate of liquid removal from the casing and a desired ultimate depth level of liquid in the casing above the pump. A novel fluid pressure sensing mechanism mounted on the shaft at ground level permits the shaft to rotate while providing an accurate reading of the downward force on the shaft. Computerized controls receive the pressure signals from the sensing mechanism and control the rate of operation of the pump motor in order to achieve a desired rate of pump operation to efficiently produce a desired rate of pump down and a desired liquid depth in the casing. Preferably, all of these elements are installed and maintained above ground.

8 Claims, 11 Drawing Sheets

CONTROL APPARATUS AND METHOD FOR CONTROLLING THE RATE OF LIQUID REMOVAL FROM A GAS OR OIL WELL WITH A PROGRESSIVE CAVITY PUMP

CROSS REFERENCE TO RELATED APPLICATION

This application is a continuation-in-part of applicants' provisional patent application, Ser. No. 60/029,269, filed Oct. 25, 1996 now abandoned.

FIELD OF THE INVENTION

The present invention relates to a method and apparatus for controlling the liquid level and the rate of liquid draw down in a gas or oil well employing a progressive cavity rotary pump.

BACKGROUND OF THE INVENTION

In conventional natural gas and oil wells, the natural gas and/or oil product (or both) is retrieved from pockets that may be as much as 1500 feet or more below the surface of the ground. The product is often present with water under pressure in certain materials such as shale. A conventional practice for removing the gas and oil is to sink a well having a hollow outer casing and a hollow inner tube, with the outer casing being perforated in the area where the product pocket is located. The liquid oil and/or water, (sometimes containing gas) infiltrates the perforated casing and the liquid is withdrawn from the well through the tube or pump located in the tube.

The process of removing gas with a well of this nature is to let the gas and liquid seep into the outer casing through the perforated openings in the casing. When the liquid enters the casing, the gas separates from the liquid and rises off of the top of the liquid, where the gas is drawn off for use from the top of the outer casing. The infiltration of liquid into the casing proceeds until the liquid reaches its own level in the outer casing, at which time no further liquid and entrained gas will enter the outer casing. It is thus necessary to continuously pump the liquid from the outer casing in order to make room for new gas containing liquid in the casing. This pump fitted to the inner tube at the bottom of the well draws liquid from the bottom of the outer casing and delivers the waiter upwardly through the inner tube where it exits the inner tube at ground level through a liquid outlet.

The pump can be the same for both a liquid only and for a well that includes liquid and gas. The pump is a submerged pump that is actuated by a pump rod that extends upwardly to a drive mechanism located above ground level. One type of pump is a rotary pump which operates by rotating the pump rod. A so called progressive cavity pump (sometimes called a PC pump) is an industry standard rotary pump used for dewatering oil and gas wells that produce large volumes of water.

Certain problems are encountered when the rate of "pumping down" or removing liquid from the well is not proportional with the rate at which liquid enters the well. First, if the liquid is removed too slowly, the liquid will rise above the perforations in the casing and will restrict or even stop gas removal. On the other hand, if too much liquid is removed or liquid is removed at too fast a rate, other problems can occur. Removal of liquid at too fast a rate does not give gas sufficient time to separate from the liquid. This causes the pump to pump substantial volumes of gas as well as liquid up through the tube. Pumping gas requires more pump force and reduces the efficiency of the pump, causing the pump to overheat and possibly damaging or destroying the pump. In addition, pumping gas through the tube liquid outlet is undesirable. Another problem occurs if the pump in effect pumps all of the liquid out of the outer casing, allowing the pump to run dry. This is particularly disastrous with a PC pump, which has rubber components which will burn up almost immediately if a pump is permitted to run dry. Replacement of a PC pump at a depth of 1500 feet is a very expensive proposition.

A number of devices have been used for measuring liquid depth in a well casing or controlling pump shut off after the pump runs dry. These devices, however, have had drawbacks. At the present time there is no reliable way to continuously and accurately measure and control the depth of the liquid in the outer casing while maintaining optimum pump efficiently, in order to make sure that a progressive cavity pump operates at the most efficient speed and does not run dry.

An object of the present invention is to provide an improved method and apparatus for detecting the level of liquid in a well casing and controlling both the depth of liquid in the well casing and the rate of liquid removal or pump down in the well casing in order to maximize pump efficiency and gas separation from the liquid.

For purposes of this application, the liquid in the pump casing can be water or oil or a combination of both. The water can be saltwater or fresh water. The liquid can include gas or can be substantially gas-free. The liquid could include other liquids in addition to or instead of water, such as oil.

SUMMARY OF THE INVENTION

A method and apparatus for controlling the level efficiently, and rate of removal of water from an oil or gas well using a progressive cavity pump operated by a rotating drive shaft extending downwardly from ground level to the pump comprises a sensor that detects the downward force on the shaft produced by the dynamic operation of the pump; and a control mechanism responsive to the output from the sensor that correlates the downward force on the pump with liquid depth in the casing and controls pump speed in order to achieve a desired rate of liquid removal from the casing and a desired ultimate depth level of liquid in the casing above the pump.

A novel fluid pressure sensing mechanism mounted on the shaft at ground level permits the shaft to rotate while providing an accurate reading of the downward force on the shaft. Computerized controls receive the pressure signals from the sensing mechanism and control the rate of operation of the pump motor in order to achieve a desired rate of pump operation to efficiently produce a desired rate of pump down and a desired liquid depth in the casing. All of these elements can be installed and maintained above ground.

These and other features and advantages of the present invention will hereinafter appear, and, for purposes of illustration but not of limitation, a preferred embodiment of the invention is described below and shown in the appended drawings.

DETAILED DESCRIPTION OF THE PREFERRED EMBODIMENTS

Figure 1:
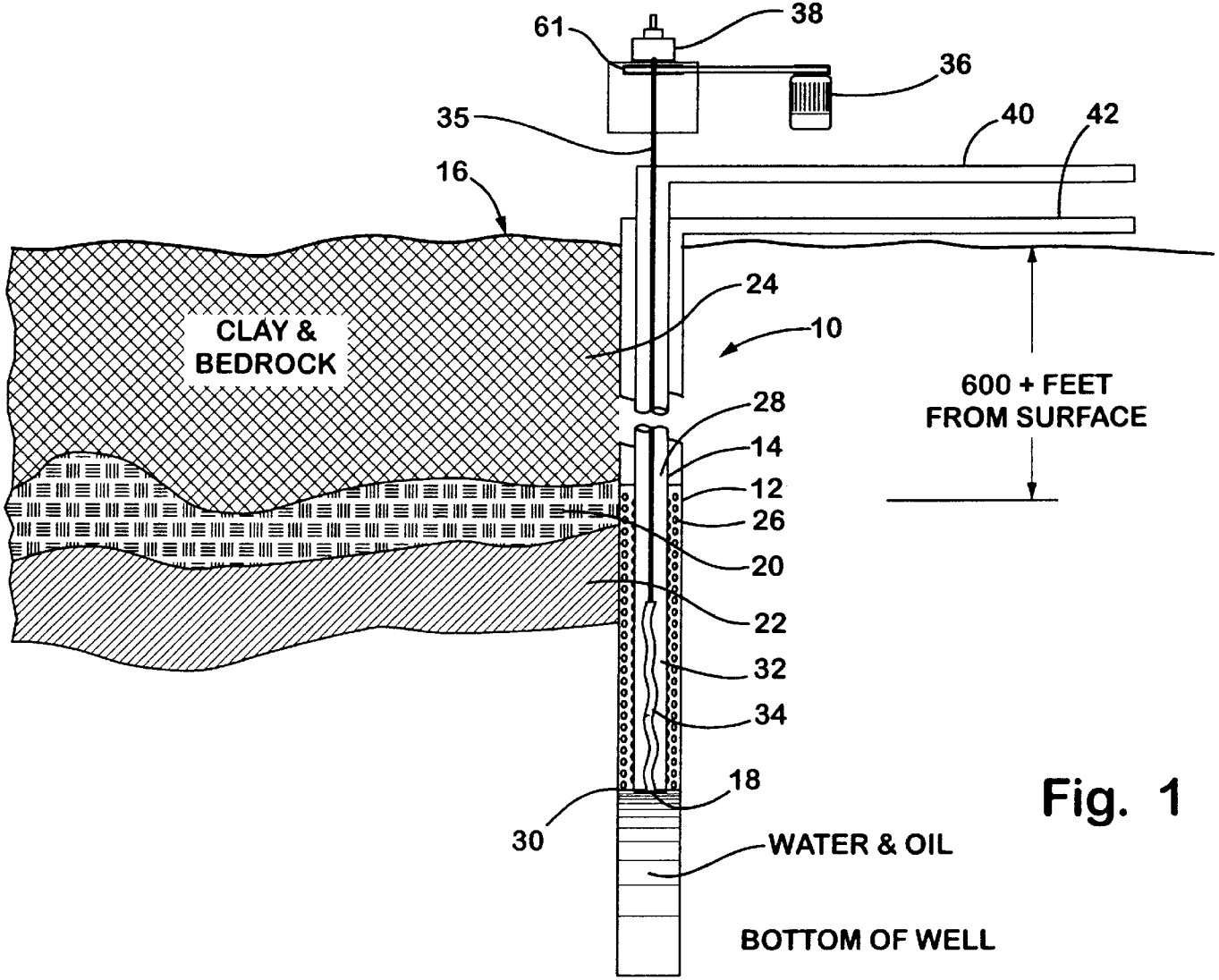
FIG. 1 is a pictorial view of a pump employing a control apparatus of the present invention.
Figure 2:
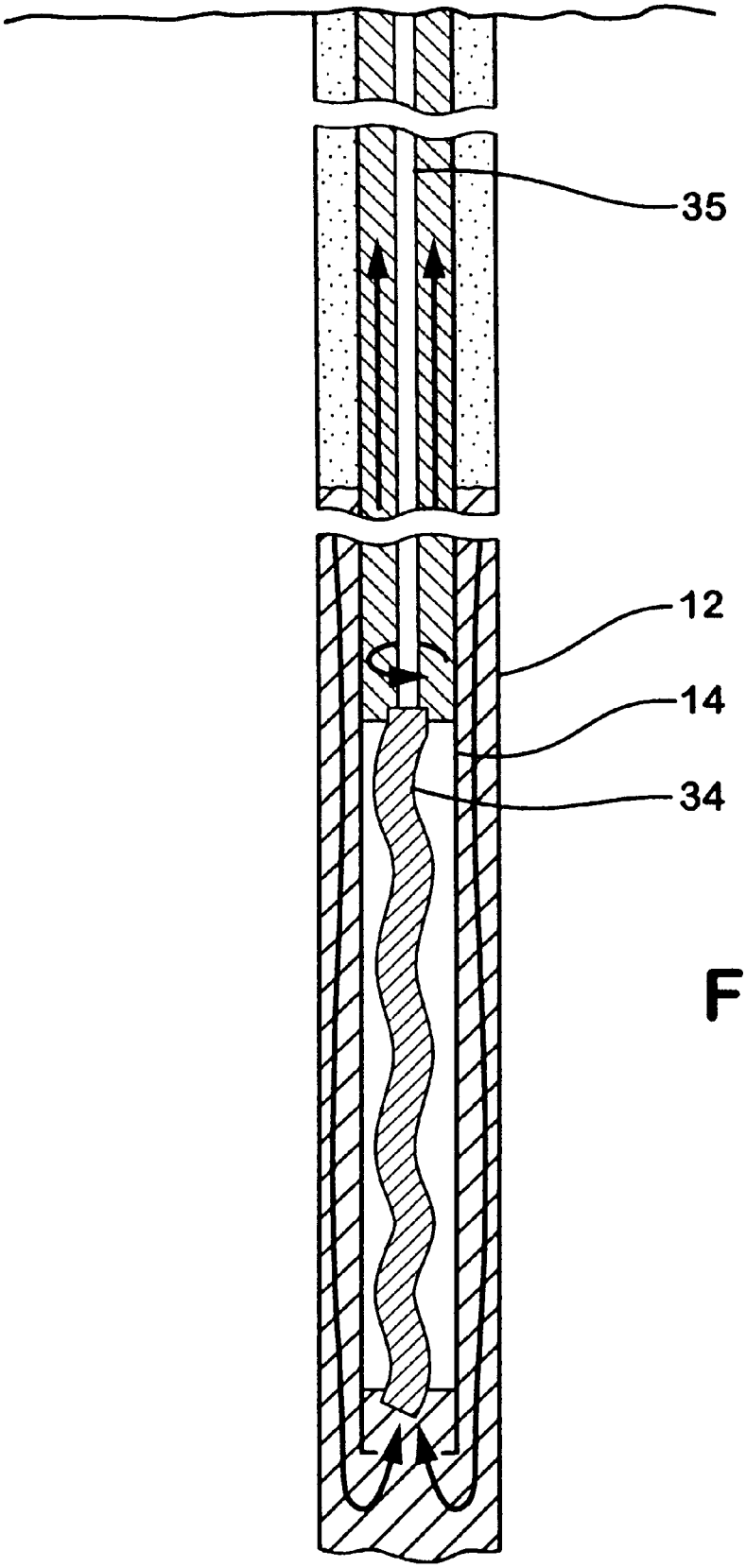
FIG. 2 is a schematic view showing the operation of the pump of the present invention in removing liquid from a well.
Figure 3:
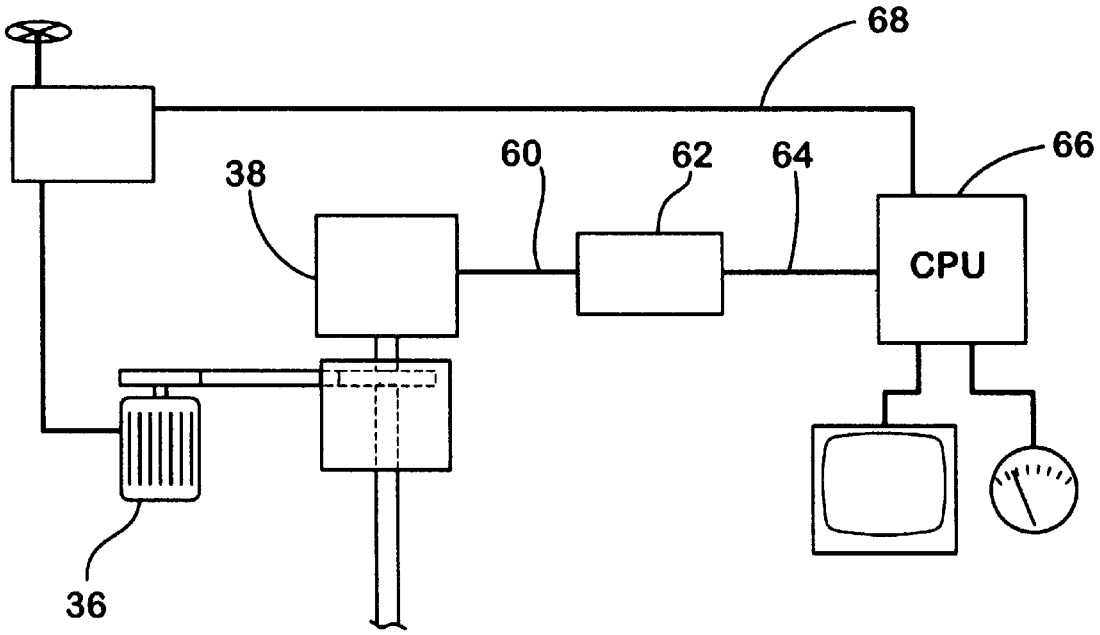
FIG. 3 is a schematic view showing the manner in which the pump force sensor of the present invention is employed for purposes of controlling pump motor speed.

Referring to the drawings, a well 10 in FIG. 1 comprises outer casing 12 and inner tube 14 that extend from ground level 16 to as much as 1000 feet or more below ground level. For purposes of illustration the present invention will be described in conjunction with a gas well wherein gas is to be separated from water. It is understood that the water can be combined with oil or other fluids (or even some sand) and the pump can be used for liquids only, where the formation includes insignificant quantities of gas. The control apparatus would even be used for a water only pump.

Subterranean gas formations 20 and 22 are positioned below a clay and bedrock formation 24. These formations are illustrative only, and various other gas producing formations can exist. One type of gas formation from which gas is sometimes retrieved is a shale formation wherein gas and a liquid, usually oil and water, but possibly other liquids such as well, are retained under pressure. The bottom 18 of tube 14 terminates below the gas formations.

Outer casing 12 is an elongated hollow cylinder having a gas outlet 42 at the top of the casing above ground. The casing is provided with a series of perforations 26 that extend from an upper end 28, which is usually positioned somewhat below the upper level of the gas and oil formation, to a lower end 30 which may extend all the way down to the end of the casing, which is at or below the lower end 18 of tube 14.

A rotary pump, specifically a progressive cavity pump 32, is mounted at the lower end of tube 14 and comprises a helix type of pump member 34 mounted inside a pump housing. The pump member 34 is attached to and driven by pump "string" or pump rod 35, which extends upwardly through the tube and is rotated by drive motor 36 in a conventional well head assembly 39 above ground level. The tube has a liquid outlet 40 at an upper end thereof above ground level. These elements are shown schematically in FIG. 1, the construction and operation of a progressive cavity pump being conventional.

Figure 4:
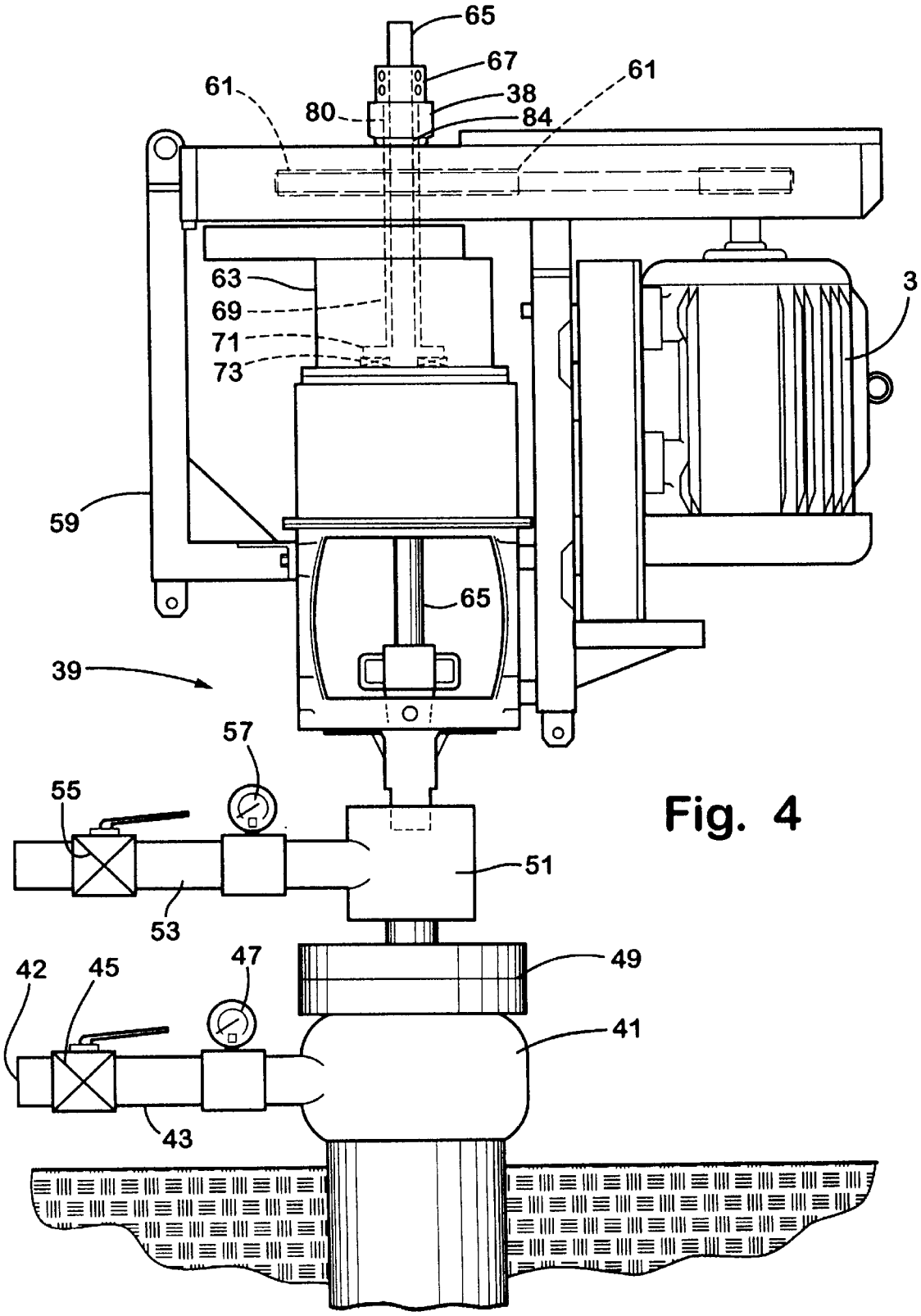
FIG. 4 is an elevational view of a well head fitted with the sensor of the present invention.
Figure 5:
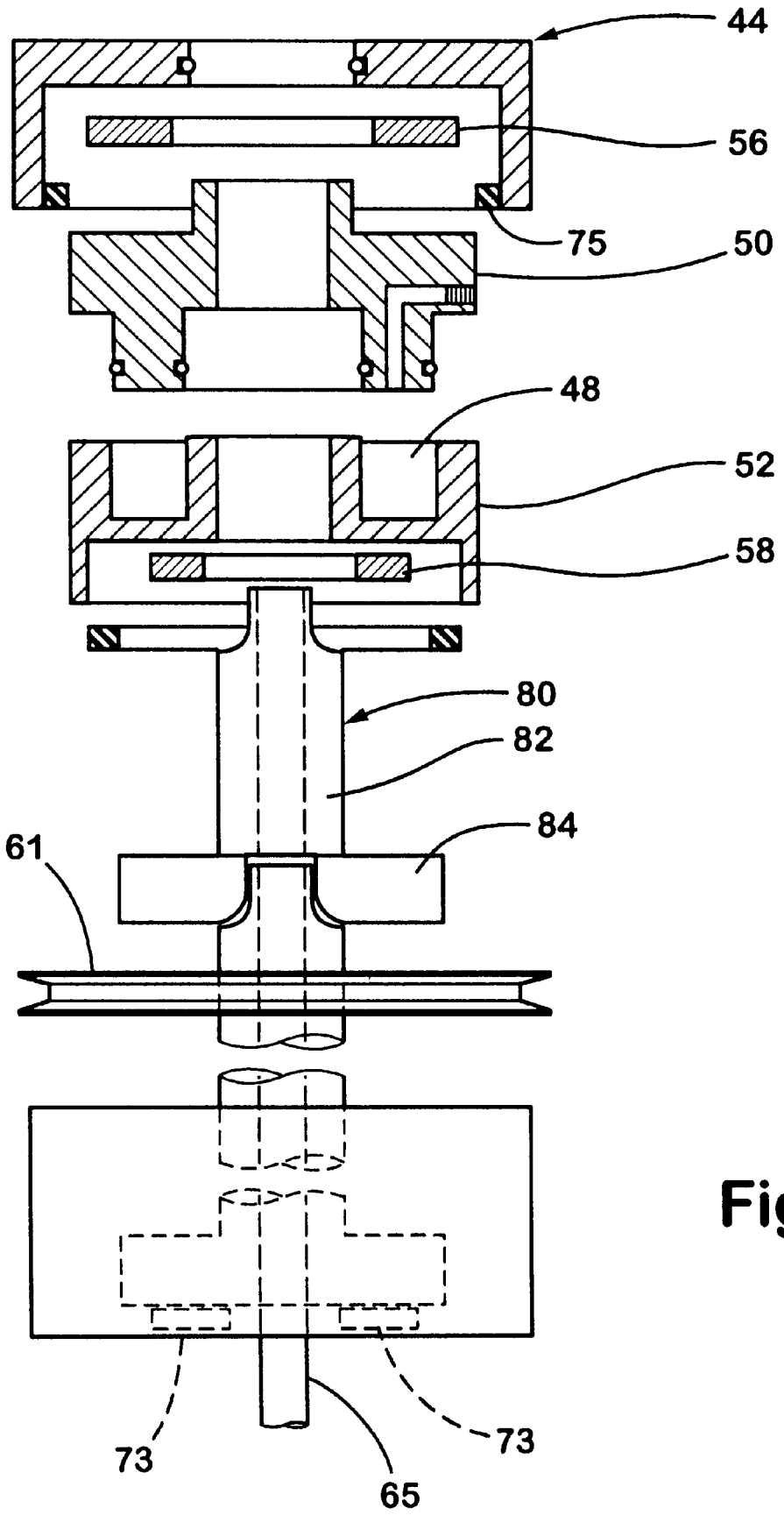
FIG. 5 is an exploded view of the pressure sensor of the present invention.
Figure 6:
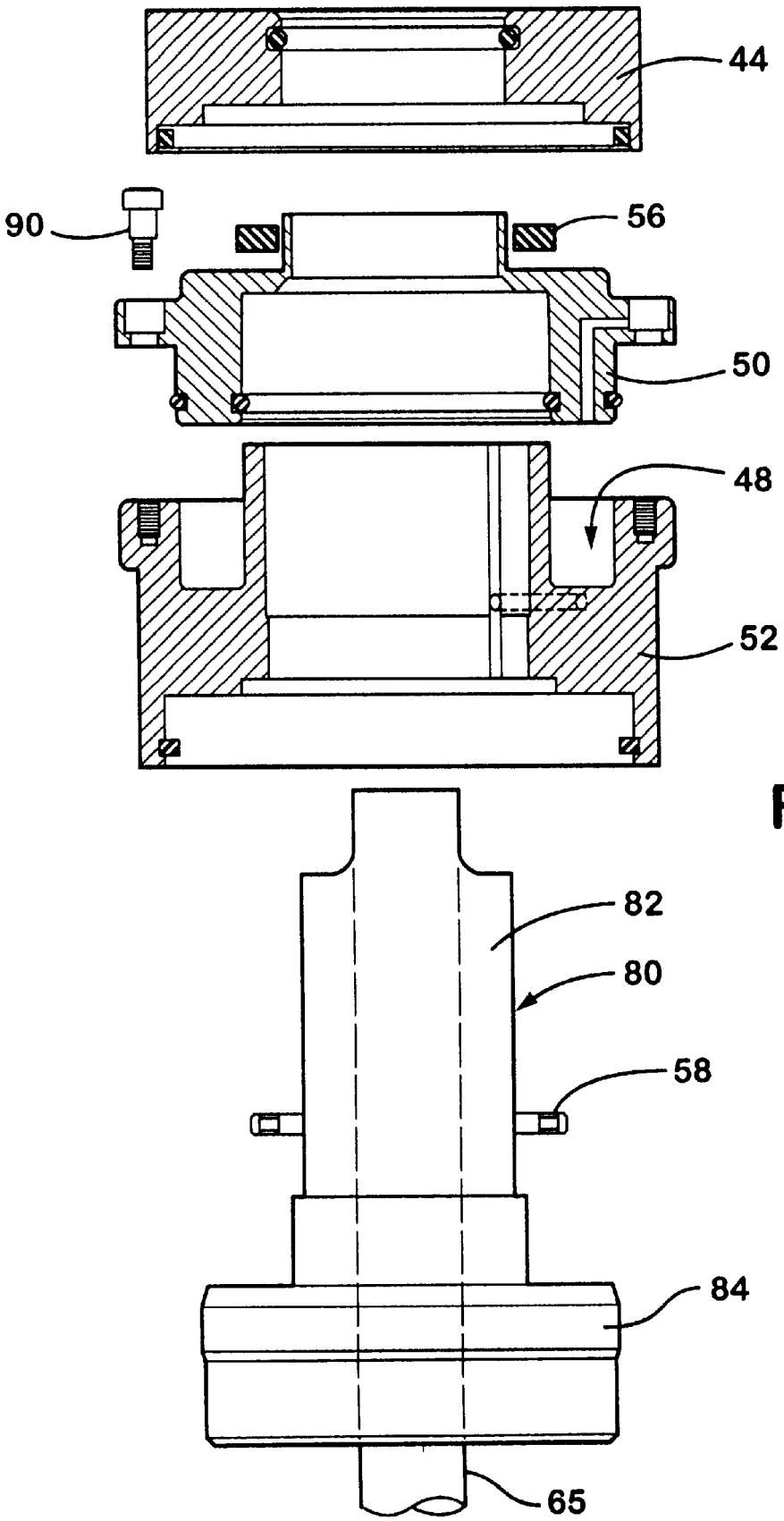
FIG. 6 is another exploded view of the pressure sensor of the present invention.

The construction of the well head assembly is shown in FIG. 4. The upper end of the casing is connected to a well head casing 41, which is in turn connected to a gas line 43. A shut off valve 45 and a pressure valve 47 are included in the gas line.

The well head tubing is connected through a flange 49 to a water chamber 51 called a pump T, and this chamber is connected to a water outlet line 53, which also includes a shut off valve 55 and a pressure gauge 57. A well head support assembly 59 is mounted on the pump T, and this supports motor 36 and pulley driver mechanism 61 and bearing box 63.

The pump rod is coupled to a smooth above-ground extension rod called a polish rod 65 at the well head assembly, and the polish rod extends through the well head. A bracket 67 called a clutch block is bolted to the polish rod at the top of the well head. The bracket fits non-rotatably on a drive member 69 that is clamped on the polish rod. A flange 71 on the bottom of the drive member rides on a thrust bearing 73. The motor drive pulley is fitted on the drive member and rotates the pump rod by rotating the driver member.

The clutch block 67 is bolted rigidly on the polish rod above the well head. In a well head assembly not using the present invention, the clutch block rests on the drive member, and the weight and force of the pump rod assembly is borne on thrust bearing 73.

In the present invention a first embodiment of special sensor unit 38 (FIG. 4) or alternative sensor 100 (FIGS. 8–12) is positioned on the polish rod just below the clutch block, so it rests on the drive member 69 on the lower side and bears against the clutch block on the upper side. The full downward pull force on the pump rod is thus exerted on the pressure sensor.

The load sensor is an element in a control mechanism 44 that measures the dynamic downward pull on the pump caused by pump operation and generates an electrical control signal that controls the motor speed to limit the rate of pump operation to produce a preselected optimum range of pump down rate and casing liquid depth.

The principle of operation of the control mechanism is that the dynamic operating load (downward pull) on the pump increases as the level of water in the outer casing relative to the level of water in the inner tube decreases. After other factors are taken into account, such as pump dimension, pump efficiency, and pump torque and the weight of the pump and pump rod are subtracted from the overall downward force on the pump rod as measured by sensor 38, the sensor produces an output signal representative of the pumping load on the pump, and this in turn is representative of the liquid level in the outer casing.

In any aspect of the present invention where an electronic sensor signal is created, the signal can be transmitted by low strength radio frequency transmissions in addition to transmission by electrical wire.

In the preferred practice of the present invention, sensor 38 is a fluid pressure sensor or load cell mounted concentrically about polish rod 65 at a position above ground level. Fluid pressure sensor 38 comprises a fluid filled chamber 48 positioned between a movable piston 50 on an upper side and a fixed position cylinder 52 on a lower side. Piston 50 and cylinder 52 are mounted on a driver shaft extension 80. Piston 50 is rotatable with respect to the polish rod but is moved axially along with vertical movement of the polish rod by means of a load plate 44 positioned on the driver shaft extension and polish rod on the upper side of piston 50. Load plate 44 engages clutch block 67 which is fixed on the polish rod. A thrust bearing 56 in an oil bath is positioned between the load plate and the movable piston and permits rotation of the pump rod and load plate without rotation of the piston. Seals 75 seal the oil bath. Thus, the weight of the pump rod and the dynamic force on the pump rod produced by operation of the pump are represented by a downward pull on the piston by means of the load plate and clutch block.

Stationary cylinder 52 rests on another set of thrust bearings 58, which in turn ride on large keyed driver extension member 80 in the shape of an elongated cylinder 82 having an outwardly extending cylindrical flange 84 on a lower end thereof. The elongated body 82 fits rotatably through central axial openings in the piston and cylinder and thrust bearings and rests on the top of well head driver member 69. The driver extension transfers the downward force of the pump rod (polish rod) from the clutch block through the pressure sensor cylinder to the thrust bearings 73 supporting the well head driver. The upper end of the driver shaft extension is keyed and fits in a slot in the underside of the clutch block, in order to transmit rotation forces to the clutch block and polish rod from the drawer member 68. The weight of the polish rod is borne on the pressure sensor, however.

The fluid chamber between the piston and the cylinder is formed between an annular projection on the piston that fits in an annular recess in this cylinder. Pressure is maintained in the fluid chamber by sealing the piston in the chamber with paraback glands in combination with "O" ring seals and extremely close tolerances. For example, there may be a two thousandths of an inch clearance between the piston and cylinder.

Figure 7:
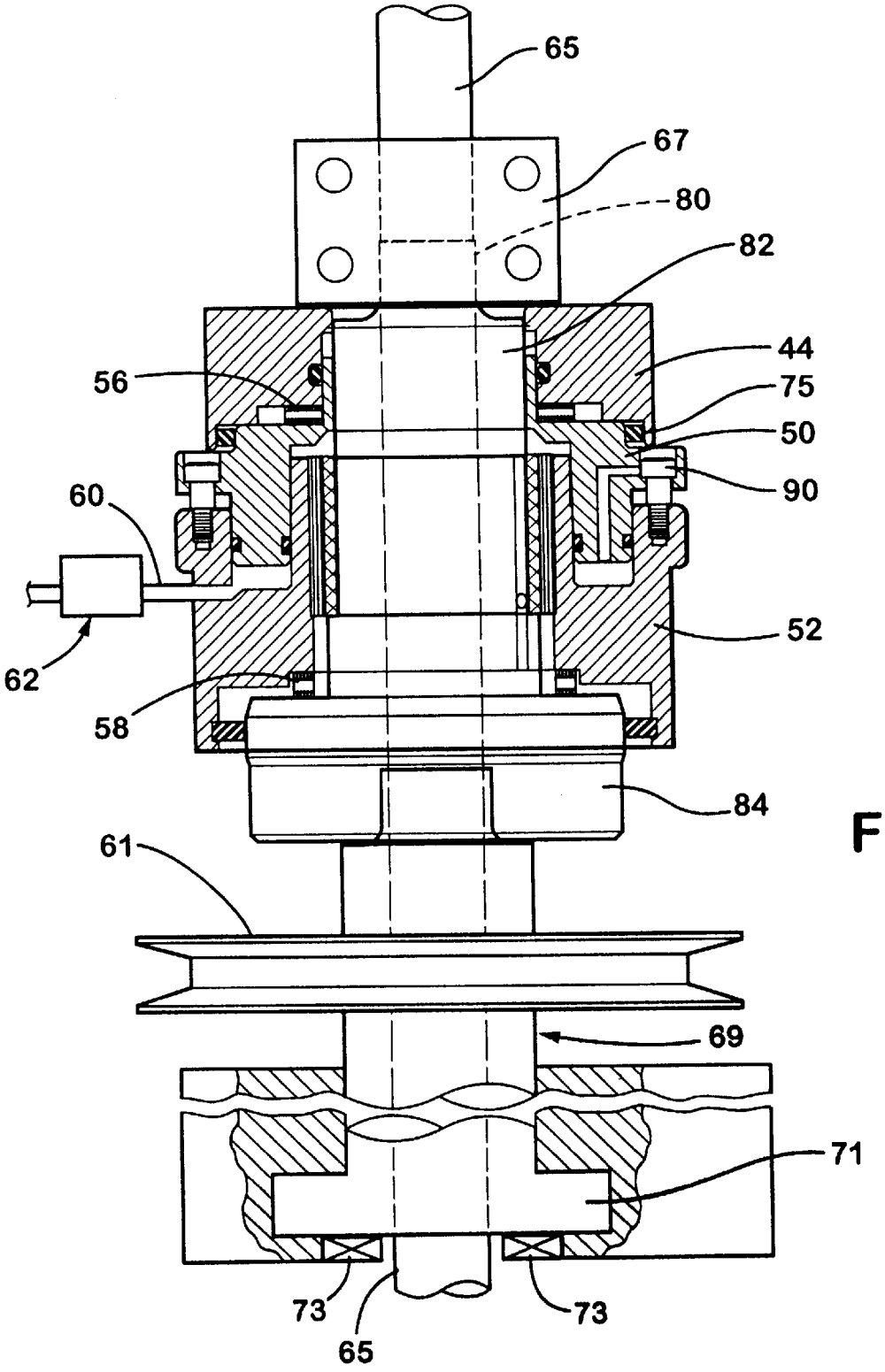
FIG. 7 is a sectional view of the assembled pressure sensor of the present invention.

The piston and cylinder are mounted together so that they are non-rotatable with respect to each other, but the piston is provided limited axially movement with respect to the cylinder. As shown in FIG. 7, the two components are bolted together by a bolt 90 that is constructed to permit axially sliding between the two members.

The entire load cell assembly is built in such a way that the device can transfer torque through its center while at the same time sensing the axial dynamic load on the pump rod which also passes through the vertical center.

While it may be possible to use other load measuring devices for measuring the level of the dynamic pump force, such as strain gauge technology, the present fluid sensor provides a very high degree of accuracy that is not present in other types of devices, and other types of devices could have problems in being connected to a rotating shaft. Thus, the fluid pressure sensing device is deemed to be an important feature of the present invention.

In operation, downward force on the rotating shaft has the effect of compressing movable piston 50 against the fixed position cylinder 52, and this causes compression of fluid 48 between the two members. The pressure of the fluid thus represents the downward force on the shaft represented by the weight of the elements plus the dynamic force caused by operation of the pump. The fluid in chamber 48 communicates by conduit 60 to an electrical transducer 62 that converts the pressure signal into a corresponding electrical signal. Electrical signal is conveyed by lead 64 to a controller 66 that interprets the electrical signal in conjunction with other data in order to generate an output signal through line 68 that controls the speed of the pump motor and thus controls the rate of rotation of the pump itself.

The controller includes a central processing unit CPU that intermittently samples the data for the well and issues motor speed control signals in order to cause well pump down at a predetermined desirable rate and to restrict pump speed to a speed that will maintain a predetermined maximum depth in the casing after pump down has been completed. This CPU can be in the form of a programmable logic controller or other type of computer, and the computer can be a dedicated stand alone computer or a remote terminal that provides for remote reading of the computer output. Any type of computer that can compute floating point values and high resolution and analog input information either before or after conversion from analog to digital will suffice.

While the preferred mode of operation of the controller is an automatic mode that causes pump down at a predetermined rate and then maintains a predetermined maximum depth all automatically, the system can be set up to operate manually in response to a visual display that indicates the rate of pump down and the depth of liquid in the casing. Manual motor control dials can be manually operated to vary pump speed as desired.

In operation, the well and pump are established and then the controller is set and actuated to initiate pump action. Desirably, the controller is set to maintain a relatively slow rate of pump down. While a progressive cavity pump can typically be adjusted to provide for varying rates of pump down of one quarter ft. per minute to 50 ft. per minute, a rate of pump down in a range of about ½ ft. per minute is desirable. This rate may vary somewhat depending upon the extent of completion of pump down and the particular circumstances of a particular well.

It is an important feature of the present invention that the rate of pump down is controlled as well as the depth of water in the outer casing. As stated above, when pump down proceeds too fast, gas does not have enough time to separate from the liquid and is forced through the pump, reducing the efficiency of the pump and plumping gas through the liquid outlet.

To further minimize pumping of gas, it is desirable to maintain casing liquid depth at just below the bottom of the casing perforations. This makes the liquid depth at about 100 feet above the pump. This will vary from well to well.

The present invention desirably includes an automatic adjustment mechanism that varies the rate of pump operation in order to maintain an efficient rate of pumping. Typically, as pump down proceeds, the rate of operation of the pump is gradually increased. A rate of increase of 1 rpm every five minutes is typical.

The control logic in the CPU correlates the reading of the load cells with the depth of liquid in the casing as follows:

(1) An initial reading on the load cells when the liquid levels in the casing and tubing are equal and the pump is off is zeroed out to eliminate the weight of the pump string;

(2) The pump is then operated for a while, desirably until the casing level is drawn down about 25% of the desired distance, a reading is noted, and the depth of the liquid in the casing is measured with an echo meter or the like; this reading represents the dynamic force exerted by the pump summed with a number of positive and negative weight factors that vary the downward force on the pump string. These include the weight of liquid in the casing, the gas pressure in the casing, the weight of liquid in the tubing, and the head pressure on the liquid in the tubing.

(3) With the depth of the casing being known for this reading, all of the weight factors are known. These are eliminated from the reading to produce a value equal to the dynamic downward force created by operation of the pump.This value is divided by the depth of the casing liquid to produce a factor which can be called a pump multiplication factor.

(4) For subsequent readings of the load sensors, the depth of the liquid can be determined by applying the pump multiplication factor to the reading. Thus, the depth of liquid in the casing is continuously determined. This can be used to determine the rate of draw down in the casing and can be used to maintain a desired rate of draw down. This information can also be used to detect if other factors affect pump operation. When liquid is being drawn down gradually, the controller notes a gradual increase in pump pressure and rotation speed. If, however, the pump load or rotation rate changes unexpectedly or dramatically, this can indicate that the pump has run dry or the pump is sucking gas. In such a case the controller may automatically slow the pump to alleviate the condition. The point is that the controller, employing all of the information and data that is fed to it, can automatically modify pump operation to maintain stable conditions and maximum pump efficiency under a variety of conditions.

Another embodiment of the pressure sensor of the present invention is shown in FIGS. 8–12. In this embodiment, sensor 100 employs electronic load cells instead of a fluid pressure cylinder. This may sacrifice some sensitivity but eliminates moving parts.

Sensor 100 comprises a cylindrical body 102 having an axial opening 104 therethrough that fits over the polish rod 65 in the same position as sensor 38. Body 102, however, fits directly on the polish rod and does not employ a driver extension member 80 as in sensor 38. Body 102 has a slotted opening 106 in the lower end thereof that fits over the tab 108 on the upper end of drive member 69, just the same way as driver extension member 80 fits on and is rotatably driven by drive member 69.

Body 102 has a transverse slot 110 in the upper surface that extends through the axis of the body. Recesses or cavities 112 and 114 are positioned on opposite sides of the slot and are open on the top thereof. A power generator 116 comprising two coils mounted in epoxy is mounted in recess 112. A small radio transmitter 117 is mounted in the other recess 114 and connected by lead 118 to the power generator, which powers the transmitter. A rectangular load plate 120 fits in the transverse slot along with one or more electronic load cells 122 positioned between the load plate and a bottom of the slot 110. The load cells are conventional and incorporate a wheatstone bridge 122 (FIG. 12) for varying the output voltage in relation to a change in load on the cells.

An upper edge of the load plate extends upwardly above the top of body 102 and fits in a slot 130 formed in the lower sides of blocks 132 that form clutch block 134. The blocks are clamped non-rotatably on the polish rod 65 by threaded fasteners that engage threaded openings in the blocks. The clutch block, carrying the entire weight of the pump and pump rod, thus rests non-rotatably on the load plate of sensor 100, and the magnitude of the down load on the pump is thus registered on the load cells as they rotate with the pump.

The variable load cell output is amplified in amplifier 136 and sent to a signal conditioner 138, which converts the signal to a pulsed output. The pulsed output carries a relative frequency to radio transmitter 117, which incorporates a signal strength strong enough to transmit a pulsed output to a local receiver 140, but small enough physically to fit inside the cavity 114 in the body. Typically, a 310 MHz low power signal is used. A spread spectrum transceiver is also an option. This transmitter frequency must exceed the maximum frequency being generated by a volt to frequency circuit in the signal conditioner. The transmitter thus rotates with the pump rod, while the receiver is mounted at a separate, stationary location. The receiver output is then converted in a signal converter 142 from a pulsed radio output signal to an analog voltage input for the controller to interpret.

Figure 8:
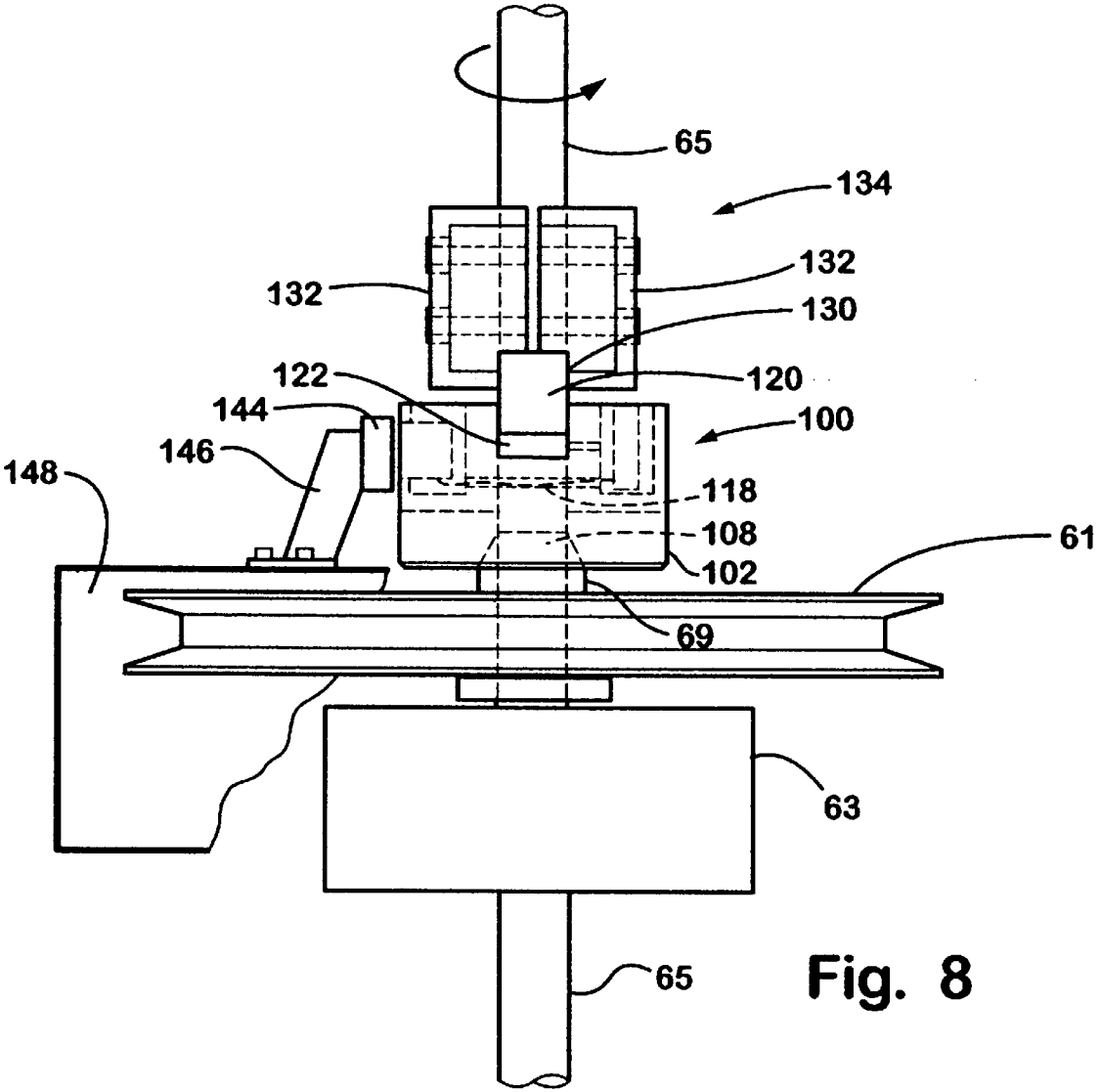
FIG. 8 is a schematic side elevational view of a second embodiment of the pressure sensor of the present invention.
Figure 10:
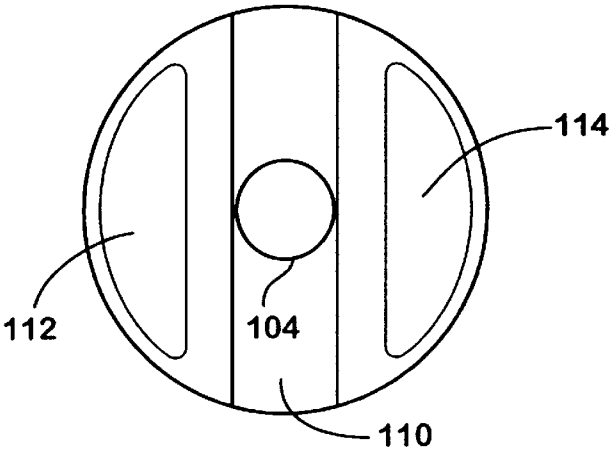
FIG. 10 is a plan view of the pressure sensor of FIG. 9.
Figure 9:
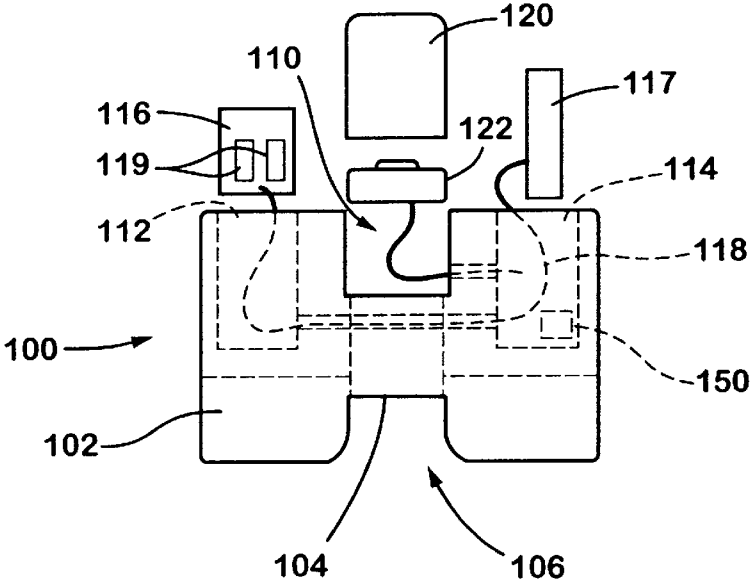
FIG. 9 is an exploded schematic side elevational view of the pressure sensor of FIG. 8.
Figure 11:
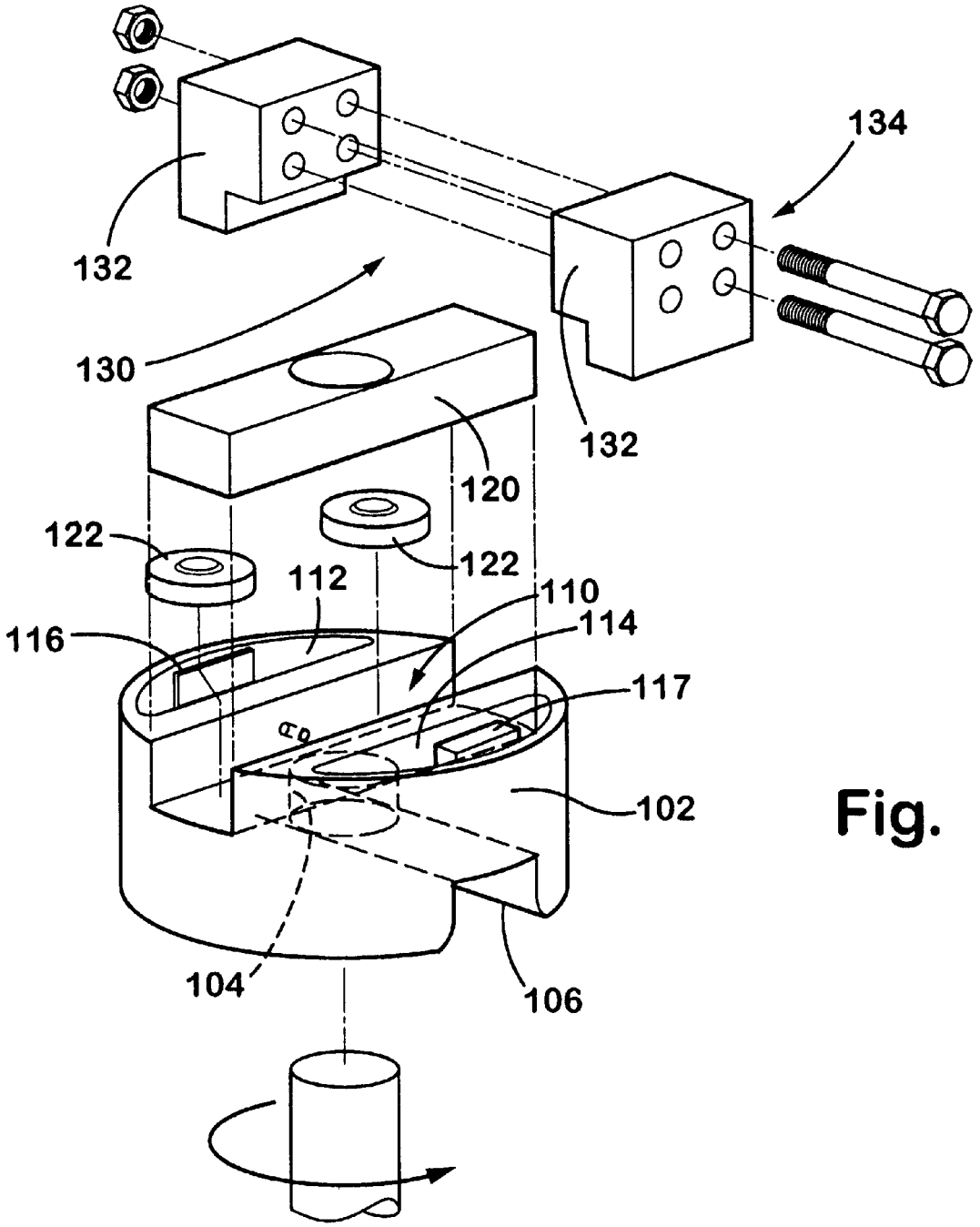
FIG. 11 is an exploded perspective view of the pressure sensor of FIG. 8.
Figure 12:
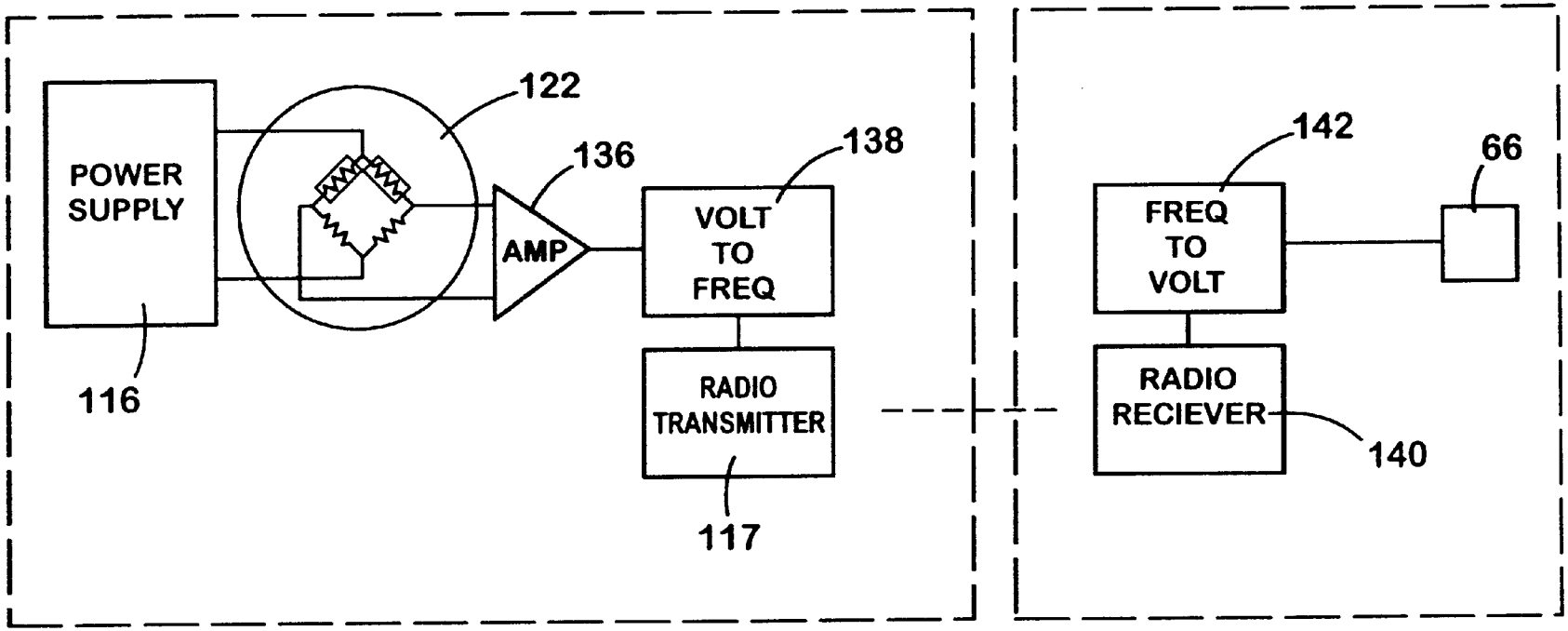
FIG. 12 is a schematic electrical circuit diagram of the electrical circuit of the pressure sensor of FIG. 8.

Power for the transmitter is generated in the two coils 119 of power generator 116. A magnet 144 is mounted by a mounting bracket 146 outside of the cell on the pump head shield or cover 148 in a stationary position (FIG. 8). As the cell rotates, the coils pass the magnets and generate a low voltage signal resulting in enough power to run the electronic sensor, small battery 150, and radio transmitter. This eliminates the need for a replacement battery or servicing the device in remote areas.

With power being generated on board the rotating cells and the sensor information being transmitted via very low power radio signal, there are no wires connecting the cells to any other components. This means that the entire load cell sensor assembly can rotate with the pump rod, resulting in no bearings or moving parts.

It will be understood by those who practice the invention and by one having ordinary skill in the art, that various modifications and improvements to the embodiments discussed above, may be made without departing from the spirit of the disclosed concept. The scope of protection afforded is to be determined by the claims and by the breadth of interpretation allowed by law.

We claim:

1. A depth gauge for detecting water level in a gas well wherein a submerged liquid rotary pump is operated from ground level by an elongated shaft, the rotary pump being in fluid communication between an inner casing and a perforated outer casing so as to draw water downwardly in the outer casing and discharge the water upwardly through the inner casing, whereby gas can infiltrate the outer casing and pass upwardly in the outer casing to a surface outlet, the depth gauge comprising:

detection means for detecting and producing a control signal representative of the downward force exerted on the shaft by the operation of the pump, such downward force being representative of the depth of the water in the outer casing relative to the pump; control means for controlling pump operation in response to the control signal, such that the pump does not operate in a dry condition.

2. A depth gauge according to claim 1 wherein the detection means comprises:

a fluid coupling mounted on the shaft at an upper portion thereof that permits the shaft to rotate with respect to the coupling, the coupling comprising a fluid chamber compressed between a fixed position lower plate on a lower side of the chamber and an upper plate mounted in a fixed axial position on the shaft on an upper side of the fluid coupling, downward force on the shaft being transmitted as increased pressure on the fluid chamber by compression between the upper and lower plates, both plates and the fluid chamber permitting rotation of the shaft with respect to the plates and chamber, the fluid chamber having a fluid outlet for the pressurized fluid in the chamber.

3. A depth gauge according to claim 1 wherein the control means shuts off the pump before the pump runs dry.

4. A depth gauge according to claim 1 wherein the detection means generates a control signal representable of the depth of the water in the outer well casing and the control means controls the rate of pumping so as to maintain a desired level of water in the outer casing under varying rates of water infiltration into the outer casing.

5. A rotary pump depth gauge for measuring the depth of liquid in a well wherein a rotary pump mounted at the bottom of the well and operated by a rotatable vertical shaft the pump being in pumping communication between an inlet connected to a perforated outer casing and an outlet connected to an inner casing, the depth gauge comprising;

a sensor that detects the downward force on a shaft produced by pump operation by rotation of the shaft, the sensor generating an output signal representative of such downward force;

pump operation controls means that control pump operation to make sure that the pump does not run dry in response to the output signal.

6. A method for controlling the depth of water in a perforated casing of a gas well using a submerged rotary pump to dewater the well, by pumping water upwardly through a separate outlet tube, the pump being in pumping communication between the inlet casing and outlet tube, the pump being driven by a rotary drive motor at ground level which is connected to the pump by a rotating pump rod, the process comprising:

measuring the actual downward pull force on the pump rod as it rotates and isolating the component of the pull force due to the operation of the pump as modified by fluid pressure on the pump by the column of fluid in the outer casing;

calculating the theoretical pull force of the pump in the absence of fluid pressure on the pump or under the same operating conditions as are present for the measurements of actual operation of the pump;

determining the difference between the measured pull force on the pump and the theoretical pull force of the pump, and deducting the influence of the depth of the pump in the well and any other factors than water depth in the casing;

converting the value of the difference into data representative of the depth of water in the casing;

controlling the operation or rate of operation of the pump to establish or maintain a desired water level in the casing that is sufficient to prevent the pump from running dry.

7. The method according to claim 6 and further comprising adjusting the pumping rate to maintain a casing water level about 100 feet or more above the pump level.

8. The method according to claim 6 and further comprising adjusting the pumping rate so as to lower the water level in the casing slowly enough to allow gas contained in the liquid sufficient time to substantially separate from the liquid before the liquid reaches the pump.

* * * * *

UNITED STATES PATENT AND TRADEMARK OFFICE

CERTIFICATE OF CORRECTION

PATENT NO. : 5,996,691
DATED : December, 7, 1999
INVENTOR(S) : Norris, et al.

It is certified that error appears in the above-identified patent and that said Letters Patent is hereby corrected as shown below:

Column 1,
Line 46, "waiter" should be -- water --.

Column 6,
Line 31, "plumping" should be -- pumping --.

In the Claims

Column 9,
Line 2, "the depth gauge" should be -- a depth gauge --.
Line 7, "operation controls means that control pump" should be -- operation control means that controls pump --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*